US008470134B2

(12) United States Patent
Rinker

(10) Patent No.: US 8,470,134 B2
(45) Date of Patent: Jun. 25, 2013

(54) PROCESS FOR TREATING COAL BY REMOVING VOLATILE COMPONENTS

(75) Inventor: Franklin G. Rinker, Naples, FL (US)

(73) Assignee: C2O Technologies, LLC, Lexington, KY (US)

( * ) Notice: Subject to any disclaimer, the term of this patent is extended or adjusted under 35 U.S.C. 154(b) by 932 days.

(21) Appl. No.: 12/556,935

(22) Filed: Sep. 10, 2009

(65) Prior Publication Data

US 2011/0011722 A1 Jan. 20, 2011

Related U.S. Application Data

(60) Provisional application No. 61/225,406, filed on Jul. 14, 2009.

(51) Int. Cl.
*C10B 51/00* (2006.01)
*C10B 47/20* (2006.01)

(52) U.S. Cl.
USPC ..... 201/29; 201/32; 201/37; 202/108

(58) Field of Classification Search
USPC ..... 201/15, 27, 29, 32, 33, 36, 37, 38, 201/43; 202/99, 100, 108; 44/620; 432/174
See application file for complete search history.

(56) References Cited

U.S. PATENT DOCUMENTS 1,538,490 A * 5/1925 Randall ..... 202/108
1,664,723 A * 4/1928 Young ..... 201/5
1,814,980 A 7/1931 Wessel
1,976,908 A 10/1934 Wittenberg
2,029,883 A 2/1936 MacCubbin et al.
2,040,100 A 5/1936 Miller
2,044,764 A 6/1936 Bywater
2,260,072 A 10/1941 Wilton
2,366,900 A 1/1945 Weir
2,528,553 A 11/1950 Royster
2,666,796 A 1/1954 Gorin et al.
2,693,409 A 11/1954 Stephens, Jr.
2,748,063 A 5/1956 Radasch
2,774,716 A 12/1956 Kulik
3,010,893 A 11/1961 Kulik
3,375,175 A 3/1968 Eddinger et al.

(Continued)

OTHER PUBLICATIONS

Perry, R.H.; Green, D.W. (1997). Perry's Chemical Engineers' Handbook (7th Edition). (pp. 32-35). McGraw-Hill.*

(Continued)

*Primary Examiner* — Jill Warden
*Assistant Examiner* — Joye L Woodard
(74) *Attorney, Agent, or Firm* — MacMillan, Sobanski & Todd, LLC

(57) ABSTRACT

A process for treating coal includes introducing coal into a chamber and passing an oxygen deficient sweep gas into contact with the coal, the sweep gas being at a higher temperature than the temperature of the coal so that heat is supplied to the coal. The process further includes providing additional heat to the coal indirectly by heating the chamber, wherein the heating of the coal by the sweep gas and by the indirect heating from the chamber causes condensable volatile components to be released into the sweep gas. The proportion of heat supplied to the coal by the sweep gas is less than 40% of the total heat supplied to the coal. The sweep gas is then removed from the chamber and treated to remove condensable components of the coal.

36 Claims, 5 Drawing Sheets

U.S. PATENT DOCUMENTS

| | | | | |
|---|---|---|---|---|
| 3,463,310 | A | | 8/1969 | Ergun et al. |
| 3,574,065 | A | | 4/1971 | Eddinger et al. |
| 3,585,732 | A | | 6/1971 | Itahashi |
| 3,736,233 | A | | 5/1973 | Sass et al. |
| 3,938,966 | A | | 2/1976 | Kindig et al. |
| 4,028,219 | A | | 6/1977 | Baldwin et al. |
| 4,036,603 | A | | 7/1977 | Bernet et al. |
| 4,052,170 | A | | 10/1977 | Yan |
| 4,119,523 | A | | 10/1978 | Baldwin et al. |
| 4,145,274 | A | * | 3/1979 | Green et al. ..... 201/30 |
| 4,146,367 | A | | 3/1979 | Hsu |
| 4,149,939 | A | | 4/1979 | Solano |
| 4,156,595 | A | | 5/1979 | Scott et al. |
| 4,213,826 | A | | 7/1980 | Eddinger et al. |
| 4,234,386 | A | | 11/1980 | Stirling |
| 4,263,124 | A | | 4/1981 | Wickstrom et al. |
| 4,322,222 | A | | 3/1982 | Sass |
| 4,341,598 | A | | 7/1982 | Green |
| 4,395,309 | A | | 7/1983 | Esztergar |
| 4,411,766 | A | | 10/1983 | Garg et al. |
| 4,411,767 | A | | 10/1983 | Garg |
| 4,466,362 | A | | 8/1984 | Maxwell et al. |
| 4,534,847 | A | | 8/1985 | Roberts et al. |
| 4,605,790 | A | | 8/1986 | Wojtkowski |
| 4,678,478 | A | | 7/1987 | Kelland |
| 4,834,650 | A | | 5/1989 | Docherty et al. |
| 5,017,283 | A | | 5/1991 | Oder |
| 5,087,269 | A | | 2/1992 | Cha et al. |
| 5,114,700 | A | | 5/1992 | Meihack et al. |
| 5,127,586 | A | | 7/1992 | Oder |
| 5,151,159 | A | | 9/1992 | Wolfe et al. |
| 5,171,406 | A | * | 12/1992 | Shang et al. ..... 201/31 |
| 5,176,260 | A | | 1/1993 | Oder |
| 5,232,679 | A | * | 8/1993 | Jha et al. ..... 423/449.8 |
| 5,240,592 | A | | 8/1993 | Meyer et al. |
| 5,326,457 | A | | 7/1994 | Stipanovich, Jr. |
| 5,372,497 | A | | 12/1994 | Coolidge et al. |
| 5,373,648 | A | | 12/1994 | Wolf |
| 5,401,364 | A | | 3/1995 | Rinker |
| 5,496,465 | A | | 3/1996 | Fraas |
| 5,547,549 | A | | 8/1996 | Fraas |
| 5,601,692 | A | | 2/1997 | Rinker et al. |
| 5,711,769 | A | | 1/1998 | Rinker et al. |
| 5,730,069 | A | | 3/1998 | Coolidge et al. |
| 5,997,289 | A | | 12/1999 | Dover |
| 2007/0272538 | A1 | | 11/2007 | Satchell |
| 2008/0116052 | A1 | | 5/2008 | Eatough et al. |
| 2009/0119981 | A1 | | 5/2009 | Drozd et al. |
| 2009/0217574 | A1 | * | 9/2009 | Coleman et al. ..... 44/501 |
| 2011/0011719 | A1 | | 1/2011 | Rinker |
| 2011/0011720 | A1 | | 1/2011 | Rinker |

OTHER PUBLICATIONS

Berkowitz N., An Introduction to Coal Technology, 1994, 2nd Edition, pp. 102-103; 164-165.

Kreith, F., Principles of Heat Transfer, 2nd Ed. 1965, pp. 236-238.

Mahajan O. et al., Low-temperature air oxidation of caking coals. 1. Effect on subsequent reactivity of chars produced, FUEL, 1980, vol. 59, January, pp. 3-10.

Oder, R., Dry magnetic Separation of Ash, Sulfur, and Mercury From a Southwestern Wyoming Coal, presented at the 18th International Low Rank Fuels Symposium, Jun. 24-26, 2003, Billings, Mt, pp. 1-6.

International Search Report and Written Opinion, Application No. PCT/US11/51927, Dated Mar. 27, 2012.

Dadayburjor, et al., Coal Conversion Processes Liquefaction, Kirk-Othmer Encyclopedia of Chemical Technology, 2003, vol. 6, pp. 832-869.

The International Search Report and the Written Opinion, PCT/US2010/041918, dated Feb. 24, 2011.

International Search Report, Application No. PCT/US2012/039598, Dated Dec. 28, 2012.

Written Opinion of the International Searching Authority, Application No. PCT/US2012/039598, Dated Dec. 28, 2012.

* cited by examiner

PROCESS FOR TREATING COAL BY REMOVING VOLATILE COMPONENTS

STATEMENTS REGARDING FEDERALLY SPONSORED RESEARCH AND RELATED APPLICATIONS

The present invention claims the benefit of U.S. Provisional Patent Application No. 61/225,406, filed Jul. 14, 2009, the disclosure of which is incorporated herein by reference in its entirety. This invention is related to co-pending applications entitled "Process For Treating Agglomerating Coal By Removing Volatile Components," and "Process For Treating Bituminous Coal By Removing Volatile Components," filed concurrently herewith. This invention was made with no Government support and the Government has no rights in this invention.

TECHNICAL FIELD

The present invention relates to the field of coal processing, and more specifically to a process for treating various types of coal for the production of coal derived liquids (CDLs) and other higher value coal derived products for use in various industries.

BACKGROUND OF THE INVENTION

Coal in its virgin state is sometimes treated to improve its usefulness and thermal energy content. The treatment can include drying the coal and subjecting the coal to a pyrolysis process to drive off low boiling point organic compounds and heavier organic compounds. Thermal treatment of coal, including high and medium volatile bituminous, sub-bituminous and lignite, causes the release of certain volatile hydrocarbon compounds having value for further refinement into transportation liquid fuels and other coal derived chemicals. Subsequently, the volatile components can be removed from the sweep gases exiting the pyrolysis process.

Low concentrations of desirable condensable hydrocarbon compounds evolved in the pyrolysis process is problematic. In addition, the liquid versus gas separation (absorption) to remove the low concentration of volatiles is less energy efficient than that which could be achieved with a higher ratio of condensable hydrocarbon compounds to sweep gas. It would be advantageous if coal could be treated in such a manner that would enable the desirable condensable hydrocarbon liquids to be removed from the coal at much higher concentrations. A process for the treatment of coal having a much higher ratio of condensable hydrocarbon compounds to sweep gas is desirable.

SUMMARY OF THE INVENTION

In one aspect, there is provided herein a process for treating coal, comprising:

introducing coal into a chamber;

passing an oxygen deficient sweep gas into contact with the coal, the sweep gas being at a higher temperature than the temperature of the coal so that heat is supplied to the coal;

providing additional heat to the coal indirectly by heating the chamber, wherein the heating of the coal by the sweep gas and by the indirect heating from the chamber causes condensable volatile components to be released into the sweep gas, and wherein the proportion of heat supplied to the coal by the sweep gas is less than 40% of the total heat supplied to the coal;

removing the sweep gas from the chamber; and treating the sweep gas to remove condensable components of the coal.

In certain embodiments, the sweep gas supplied into the chamber has an emissivity within a range of from about 0.5 to 0.7.

In certain embodiments, at least 80% of the sweep gas is comprised of $CO_2$ and $H_2O$.

In certain embodiments, the coal is continuously supplied into one end of the chamber and removed from another end of the chamber, the sweep gas is continuously supplied into one end of the chamber and removed from another end of the chamber, and the mass ratio of the sweep gas to the coal supplied to the chamber is less than about 0.50.

In certain embodiments, the chamber is a rotary retort, and the sweep gas is continuously supplied into one end of the retort and removed from another end of the retort, and the average velocity of the sweep gas is less than about 900 feet per minute.

In certain embodiments, the chamber is a rotary retort, and the sweep gas is continuously supplied into one end of the retort and removed from another end of the retort, and wherein the average gaseous residence time within the retort is less than about one second.

In certain embodiments, the average gaseous residence time within the retort is within a range of from about 0.2 second to about one second.

In certain embodiments, the coal is continuously supplied into one end of the chamber and removed from another end of the chamber, the sweep gas is continuously supplied into one end of the chamber and removed from another end of the chamber, and the sweep gas exiting the chamber has a condensable hydrocarbon content of at least about 15% by weight.

In certain embodiments, the chamber is a rotary retort, including an inner shell mounted for rotation within a cylindrical outer shell, the outer shell including a heat source for supplying indirect heat to the inner shell, and wherein the coal is continuously supplied into one end of the retort and removed from another end of the retort, and the sweep gas is continuously supplied into one end of the retort and removed from another end of the retort.

In certain embodiments, the sweep gas removed from the chamber includes a reduced concentration of coal fines, which is further reduced by about 95% after passing through a mechanical gas/fines filter.

In certain embodiments, the reduced concentration of coal fines is about 4.5 wt % or less.

In certain embodiments, resultant coal char has a mercury content reduced by about 80%.

In certain embodiments, resultant coal char has an organic sulfur content of about 45% less than an organic sulfur content in feed coal.

In certain embodiments, the temperature of the coal within the chamber is raised to a temperature within a range of from about 1200° F. to about 1500° F. for removal of organic sulfur.

In another broad aspect, there is provided herein a process for treating coal, comprising:

introducing coal into a chamber;

passing an oxygen deficient sweep gas into contact with the coal, wherein the sweep gas has an emissivity within a range of from about 0.5 to 0.7, the sweep gas being at a higher temperature than the temperature of the coal so that heat is supplied to the coal;

providing additional heat to the coal indirectly by heating the chamber, wherein the heating of the coal by the sweep gas and by the indirect heating from the chamber causes condensable volatile components to be released into the sweep gas;

removing the sweep gas from the chamber; and treating the sweep gas to remove condensable components of the coal.

In still another broad aspect, there is provided herein a process for treating coal, comprising:

introducing coal into a chamber, wherein coal is continuously supplied into one end of the chamber and removed from another end of the chamber;

passing an oxygen deficient sweep gas into contact with the coal, wherein the sweep gas is continuously supplied into one end of the chamber and removed from another end of the chamber, the mass ratio of the sweep gas to the coal supplied to the chamber being less than about 0.50;

heating the coal directly with the sweep gas;

providing additional heat to the coal indirectly by heating the chamber, wherein the heating of the coal by the sweep gas and by the indirect heating from the chamber causes condensable volatile components to be released into the sweep gas;

removing the sweep gas from the chamber; and treating the sweep gas to remove condensable components of the coal.

Various advantages of this invention will become apparent to those skilled in the art from the following detailed description of the preferred embodiment, when read in light of the accompanying drawings.

DETAILED DESCRIPTION OF THE INVENTION

The process of the present invention pertains to treating coal using an increased partial pressure for the production of coal derived liquids (CDLs) and other higher value coal derived products, such as a high calorific value, low volatile residue (char). Desirable condensable hydrocarbon liquids are removed from the coal at much higher concentrations than capable with conventional coal treating processes. In particular, the process combines the advantages of pyrolytic heating with an attemperated, high sensible heat oxygen deficient gas stream (sweep gas) coupled with indirect heating by passing a portion of the required heat through a rotating metal shell of a rotary pyrolyzer retort as described below.

It is to be understood that the process in accordance with the present invention is particularly suited for various types of coal, including high and medium volatile bituminous, subbituminous and lignite.

In consideration of the figures, it is to be understood that for purposes of clarity certain details of construction are not provided in view of such details being conventional and well within the skill of the art once the present invention is disclosed and described herein.

Figure 1:
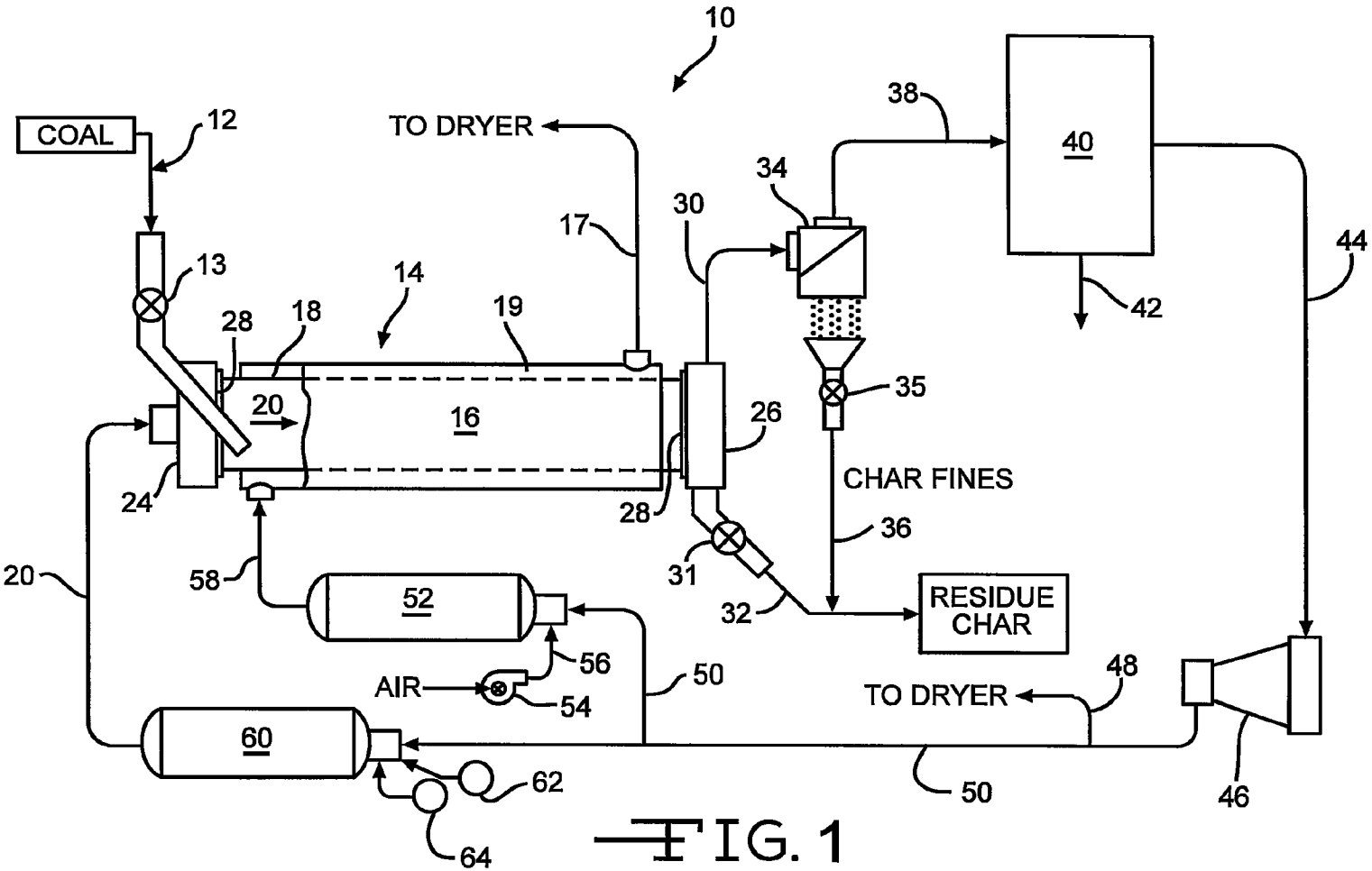
FIG. 1 is a schematic illustration of a process for treating coal using indirect gas heating according to the present invention.

Referring now to FIG. 1, a schematic illustration of a process 10 for treating coal 12 using indirect gas fired heating is shown. A stream of coal 12 is introduced into a chamber or pyrolytic rotary retort 14. The chamber can be any vessel suitable for heating coal by convection gases as well as heating indirectly by radiation and conduction. The coal 12 may be pre-sized to a range between 6 mm and 50 mm prior to being charged into the pyrolytic retort 14, but other sizes can be used. A rotary valve 13 controls the flow of the incoming dried coal stream 12, which is directed continuously into the rotary retort chamber 14.

The rotary retort 14 used for the combined direct/indirect pyrolytic heating process may be selected from a type of heat transfer device for the indirect thermal processing of bulk solid materials commonly referred to as a rotary calciner. The rotary calciner consists principally of an alloy rotary shell 16, enclosed in and indirectly heated on its exterior in a stationary furnace. The process material (i.e., coal) 12 moves through the interior of the rotary shell 16, where it is heated through a combined radiative and convective/conductive mode of heat transfer through the rotary shell wall 18. Operating temperatures of up to 2200° F. can be achieved. Rotary calciners can be small pilot-scale units, or full-scale productions units as large as 10 feet in diameter with a heated length of up to 100 feet. Units can be heated by a variety of fuels, such as gas (FIGS. 1-3), or by electric-resistive heating elements (see FIG. 5). Waste heat and/or external heat sources can also be accommodated for rotary calciners.

Materials of construction of the rotary shell 16 are selected for high-temperature service, corrosion resistance, and compatibility with process materials. The rotary shell 16 may be fabricated from a wrought heat and corrosion-resistant alloy steel. For example, Type 309 alloy is the nominal material for indirectly heated rotary calciners operating in the 1300° F. metal temperature range. A variety of features and auxiliary equipment is available to accommodate many process requirements.

Rotary calciners are ideal for specialized processing due to the indirect heating mechanism. As the heat source is physically separated from the process environment, specific process atmospheres can be maintained. Processes requiring inert, reducing, oxidizing, or dehumidified atmospheres, or those with a solids/gas phase reaction can be accommodated. Depending on the process requirements, rotary calciners can operate under positive or negative pressure, and a variety of seal arrangements are available. Internal appurtenances affixed to the rotary shell interior 16 can be employed to promote uniform heat transfer and exposure of the material to a process gas (i.e., sweep gas) 20. The indirect heating also allows for temperature profiling of the process, which provides the capability of maintaining the material temperature at a constant level for specific time periods. Multiple temperature plateaus can be achieved in a single calciner unit in this manner. Specifically, indirect heating facilitates time-temperature profiling along the length of the processing retort. The material being heated can be exposed to variable time-temperature conditions so as to alter the thermal process to achieve optimum results and to attune the time-temperature profile to deal with variable material conditions such as moisture or volatile content.

Indirectly heated rotary calciners are well known to those knowledgeable with thermal heating of bulk free flowing solids. A typical rotary retort suitable for heating coal to 1050° F. is manufactured by The A. J. Sackett & Sons Co. (Baltimore, Md.) and it is rated for transfer of 6,240,000 BTU/hour having a surface area of 602.88 $ft^2$ of indirect rotary calciner surface and a heat flux in the range of about 10,350 BTU/hr/$ft^2$.

For a heating retort having a combination of indirect and direct heating, when indirect heating is in the range of about two thirds of the total, the one third balance of heat must be supplied by a flow of gases (sweep gases 20) passing into contact with the coal 12. One method of providing sweep gases 20 is to pass a stream of oxygen deficient gases containing both inert and combustible components through an indirect heat exchanger (not shown) in which the temperature of the gas stream may be heated and/or cooled so as to provide the optimum temperature and composition. Another method of providing sweep gases 20 is to admit the oxygen deficient gas stream containing both inert and combustible components into a combustion chamber with oxygen or combustion air to release sensible heat. The gas stream serves a second purpose, other than partial heat input, serving as a sweep gas to cause the outflow of gases released in the pyrolytic treatment of the continuously flowing dried and preheated coal entering the system.

An advantage of the combined direct/indirect pyrolytic heating process shown is the co-current flow configuration. The temperatures of the heated coal residue (char) 32 and the sweep gases containing the gaseous volatiles having been pyrolytically released from the solid coal 12 can be brought essentially to equilibrium at the discharge end 26 of the rotating retort 14. The heated coal residue (char) 32 can be controllably released at the discharge end 26 of the retort 14 via a product char outlet rotary valve 31. In the illustrated embodiment, the temperature differential between the coal 12 and the sweep gases 20 at the point of desired pyrolysis process completion is in the range of from about 100° F. to about 200° F. In one embodiment, the temperature differential is about 150° F.

Although in the embodiment shown in the drawings the flow of coal 12 and sweep gases 20 is co-current, it is to be understood that the flow could be counter-current.

Another advantage of the combined direct/indirect pyrolytic heating process is the relatively substantial permissible thermal temperature differential at the charge end 24 of the retort 14. Differential temperatures between the coal 12 and the sweep gases 20 at the charge end may be in the range of about 650-750° F., or higher, resulting with an overall retort log mean differential temperature of about 300-400° F.

A further advantage of the combined direct/indirect pyrolytic heating process is found in the fact that the concentration of condensable volatiles is increased when compared to a direct heating process employing attemperated high sensible heat oxygen deficient gas for 100% of the heating. For a conventional 100% direct gas heated system, processing a non-caking, non-coking coal, the condensable hydrocarbon concentration is typically about 6.2% of the gaseous stream 30 exiting from the pyrolyzer 14. On the other hand, with 100% indirect heating, the condensable component is about 44.2% of the total gas, including water of pyrolysis released when pyrolytically processed at 950° F. For a combined indirect/direct heated system with 50% direct gas and 50% indirect heating, the condensable hydrocarbon component is expected to be in the range of about 18% of the gas stream 30 leaving the retort 14.

A still further advantage of the combined direct/indirect pyrolytic heating process is the minimization of coal char fines carryover of the off gas stream 30 from the retort 14. Based on actual pilot scale tests, the off gas stream 30 from the retort 14 carried 1.4 lbs/hr of material otherwise unaccounted for, i.e., coal char fines 36. The input dry coal 12 feed rate is 32.2 lbs/hr entering the pilot scale rotary retort pyrolyzer 14. The coal char fines 36 concentration in the exhaust gas stream 30 is about 4.3 wt %. The concentration of coal char fines 36 will be further reduced in a mechanical gas/fines filter 34, typically by 95%, resulting with a concentration of 0.22 wt % in the cleansed gas stream 38.

Optional internal lifting flights 22 (FIGS. 2 and 5) attached to the inner wall 18 of the pyrolytic retort 14 may be used to improve the mixing of coal particles 12 in transition from the initial temperature to the final desired temperature, and to improve the efficiency of gas-solid contact. As the retort 14 rotates, the internal lifting flights 22 serve to lift the coal particles 12 from the moving bed and subsequently allow them to fall as a cascade back to the surface of the axial flowing coal bed. In some rotary calciner applications, the lifting flights are arranged so as to promote continuous lifting and falling of the particles being thermally treated. Although gas-solid contact is improved, the repeated lifting and falling of the particles undesirably may result in the production of large amounts of fines and dust. The dust and fines may become entrained in the sweep gas stream and be exhausted with the desirable vapors and gases released in the pyrolytic process. Optionally, the internal flights 22 may be staged so as to provide the desired gas-solid contact with a minimum formation of coal char fines 36 and dust prior to the coal char fines being filtered via a mechanical gas/fines filter 34. With staged internal flights 22, the bed of coal particles 12 being treated in the retort 14 will experience one or more cascades according to the number of stages required to achieve the desired mixing of coal particles 12 without causing undue particle dimunitization.

In some embodiments of the rotary pyrolytic retort 14, the coal bed 12 moves in a rolling mode according to Hencin's classification. In this mode, the bed of coal particles 12 can be considered as those rolling on the surface as opposed as to those that are embedded. Those on the surface roll due to the effect of gravity. This surface layer is commonly referred to as the "active layer". These particles 12 receive heat from the sweep gases 20 by convection. The oxygen deficient sweep gas 20, containing no greater than about 1% by volume oxygen, is at a higher temperature than the temperature of the coal 12 so that heat is supplied to the coal. In other embodiments, it is contemplated that the oxygen deficient sweep gas 20 contains no greater than about 2% by volume oxygen. The active layer is enhanced by virtue of staged lifters 22 so as to promote additional internal convective heat transfer from the sweep gas 20 to the coal particles. Beneath the active layer is the mass of the coal bed 12, which is in contact with the metal wall, receiving indirect heat by conduction, as shown in FIGS. 2 and 5.

Figure 2:
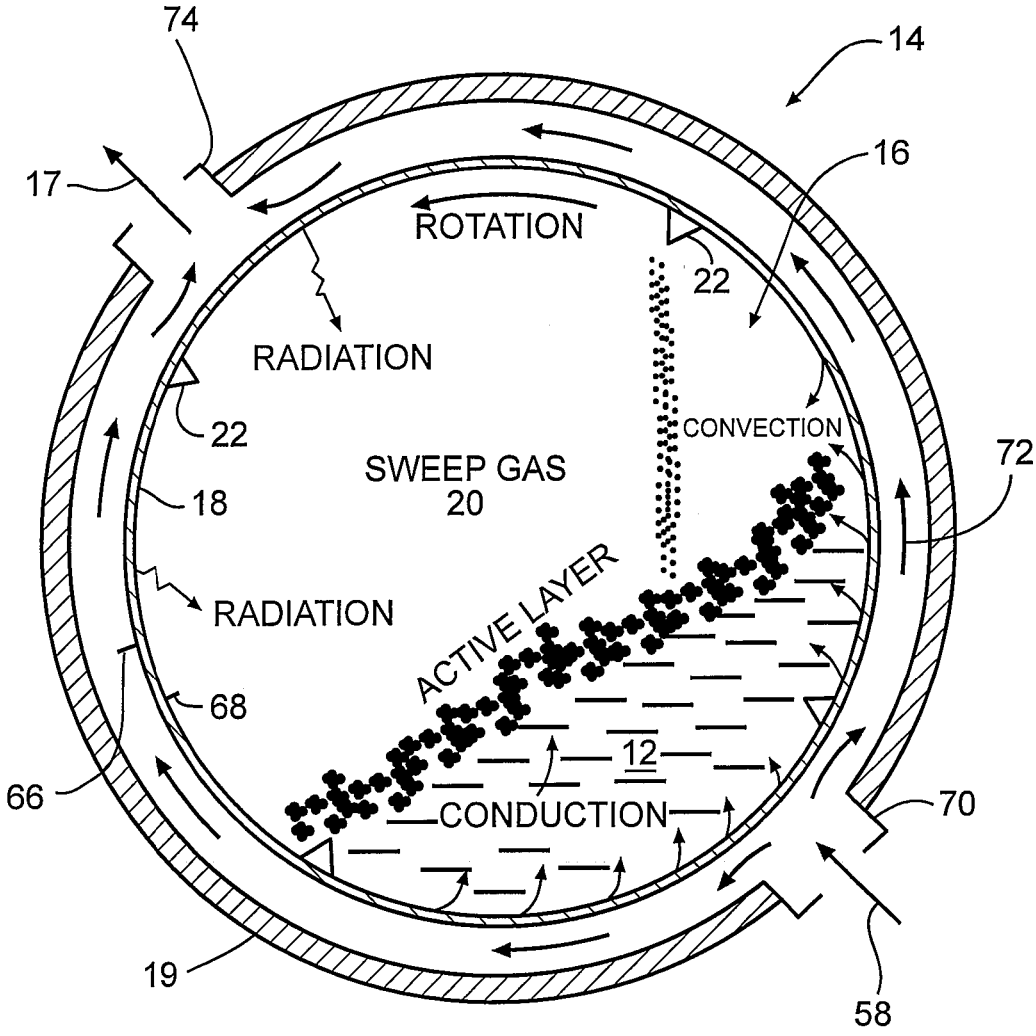
FIG. 2 is an enlarged, schematic cross-sectional view of a gas-heated retort used in the process of FIG. 1.
Figure 5:
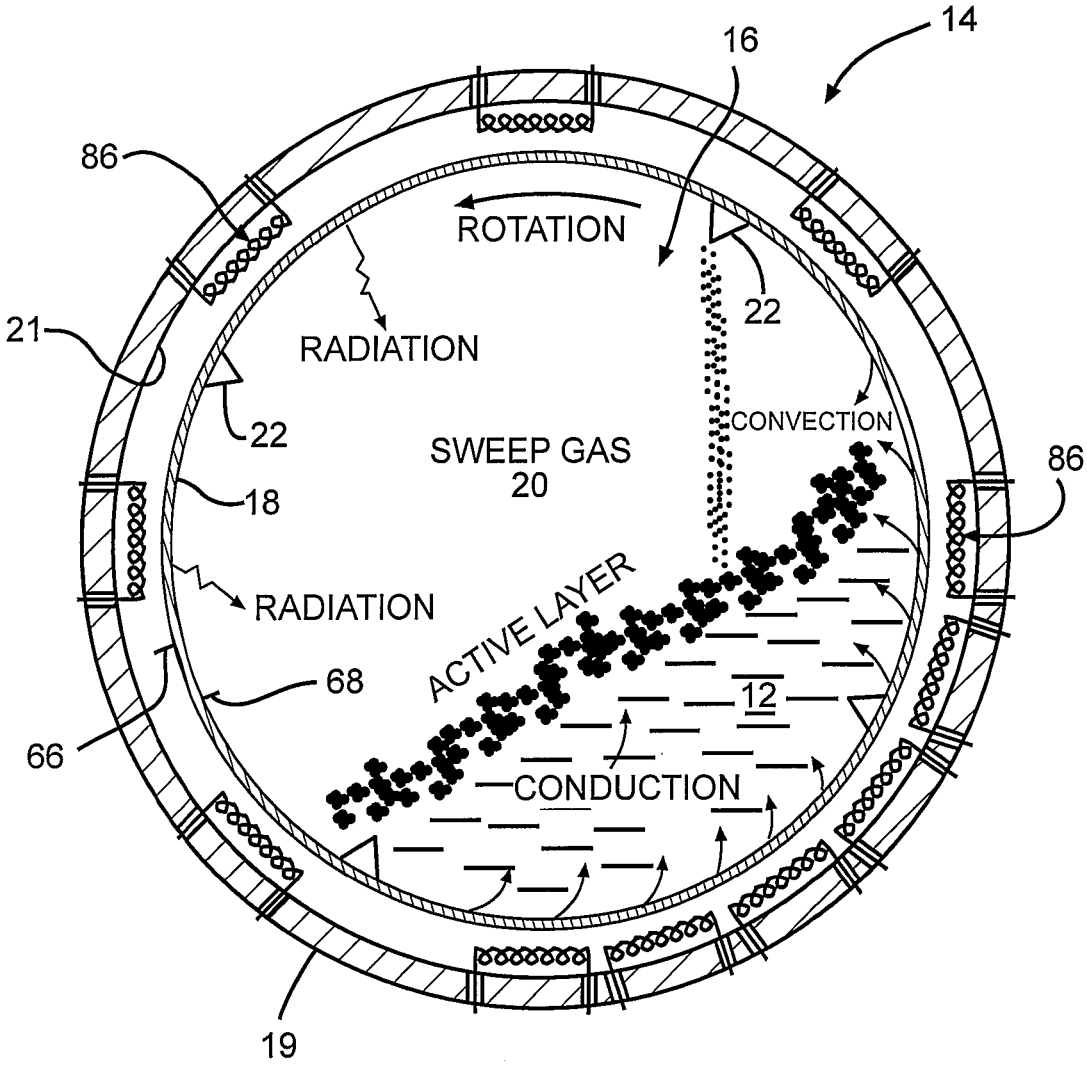
FIG. 5 is an enlarged, schematic cross-sectional view of an electrically heated retort used in the process of FIG. 4.

As schematically illustrated in FIGS. 2 and 5, the heat transfer between the sweep gas 20 and the solid coal particles 12 involves radiation, convection, and conduction. Internal heat enters the process by cooling of a sweep gas stream consisting of an oxygen deficient high sensible heat gas 20, entering co-currently at a temperature in the range of about 1200° F. to about 1800° F. and leaving the retort 14 at a temperature in the range of about 900° F. to about 1100° F. In one embodiment, the sweep gas 20 is introduced at a temperature of about 1500° F. and the sweep gas is discharged at a temperature of about 1000° F. For a sweep gas stream of 65,000 lbs/hour (0.6% $SO_2$, 67.3% $H_2O$, 2.9% $N_2$ and 29.2% $CO_2$) having a combined specific heat of 0.39 BTU/lb-° F., the process thermal component received from the sweep gas will be in the order of about 12,675,000 BTU/hour. It is preferable to limit the entering temperature to counter the water gas reaction and coal overheating. For the co-current flow pattern, with the coal 12 entering at a preheated temperature in the range of about 550-650° F., the sweep gas 20 is cooled by radiation and convection rapidly, perhaps in a matter of one to two seconds, to a mean temperature in the range of about 1200-1300° F. The coal bed 12 provides a significant heat sink in the order of 30,000,000 BTU/hour when at a temperature in the range of from about 600° F. to about 1,050° F. Further, the sweep gas 20 receives heat from the externally heated rotating metal retort shell 19, as the sweep gas 20 and vapors are transferred from the entry end 24 of the retort 14 to the discharge end 26. The heat released by the sweep gas, 12,675,000 BTU/hour, represents 42.25% of the nominal 30,000,000 BTU/hour required for pyrolysis of 141,633 lbs/hour of dried and preheated coal.

In one embodiment, the proportion of heat supplied to the coal 12 by the sweep gas 20 is less than 40% of the total heat supplied to the coal 12. In further embodiments, at least 80% of the sweep gas 20 includes $CO_2$ and $H_2O$, and the mass ratio of sweep gas 20 to the coal 12 supplied into the chamber 14 is less than about 0.50. In still further embodiments, at least 80% of the sweep gas 20 includes $CO_2$ and $H_2O$, and the mass ratio of sweep gas 20 to the coal 12 supplied into the chamber 14 is less than about 0.25.

A further advantage of the high specific heat sweep gas 20 is the relatively high emissivity in accordance with the process. Nitrogen ($N_2$) is a symmetrical molecular gas, which does not contribute to the radiative component of the gas stream. Nitrogen ($N_2$), Oxygen ($O_2$), Hydrogen ($H_2$) and dry air have symmetrical molecules and are practically transparent to thermal radiation—they neither emit nor absorb appreciable amounts of radiant energy at temperatures of practical interest, i.e., 1,000-1,500° F. On the other hand, radiation of heteropolar gases and vapors such as $CO_2$, $H_2O$, $SO_2$ and hydrocarbons are of importance in heat transfer applications. In one embodiment, the intended sweep gas, 65,000 lb/hour of gas having a constituency of about 0.6% $SO_2$, 67.3% $H_2O$, 2.9% $N_2$ and 29.2% $CO_2$, supplied into the chamber has an emissivity within a range of from about 0.5 to about 0.7, optimally with an emissivity of about 0.65. When both $CO_2$ and $H_2O$ are present in high concentrations, the emissivity can be estimated by adding the emissivities of the two components. The primary components of the composite emissivity with a beam length of 9.0 feet are about 0.45 from water vapor and about 0.20 from the carbon dioxide, with an internal retort pressure within a range of from about 0.85 to 1.3 atmospheres or, alternatively, a range of from about 1.05 to 1.20 atmospheres, and optimally at about 1.15 atmosphere. The optimal internal retort pressure enhances the downstream oil recovery process as the downstream oil collection apparatus (absorption apparatus 40) can be smaller in cross-section, i.e., absorption apparatus can be a lesser diameter, which contributes to a more effective absorption and a lower cost. The low $N_2$ component results from using oxygen for combustion/preparation of the sweep gas.

The heating of the coal 12 by the sweep gas 20 and by the indirect heating from the chamber 14 causes condensable volatile components to be released from the coal into the sweep gas. In one embodiment, the temperature of the coal 12 within the chamber 14 is raised to a temperature within a range of from about 1200° F. to about 1500° F. in order to improve removal (e.g., volatilization) of organic sulfur.

Seals 28 can be provided to restrain gas and dust flow at the charge 24 and discharge end 26 of the pyrolytic retort 14. The seals 28 are typically mechanical in nature with a riding/wear component, typically graphite or the like. The seal components 28 are restrained with springs so as to maintain the seal between the static end housings and the rotating cylindrical metal shell 16. Other types of seals can be used.

For a typical pyrolytic coal heating process, the heat required to cause a continuously entering stream of 140,000 lbs/hour of coal previously dried and preheated in the range of about 550-650° F. to be pyrolyzed has been determined by heat balance and computation to be about 30,000,000 BTU/hour. The specific heat requirement is approximately 215 BTU/lb-dried coal entering at 600° F. For the typical pyrolytic coal heating process, having an indirect heating effective surface area of 2119.5 $ft^2$, with a heat flux rate of 10,350 BTU/hr/$ft^2$, the heat supplied is therefore about 21,936,825 BTU/hr. The indirect heating component would be in the order of 21,936,825 BTU/hr divided by the total requirement of 30,000,000 BTU/hr or 73% of the total. Other rotary calciners examined show heat flux ratings of from about 4000 BTU/hr/$ft^2$ to 12,000 BTU/hr/$ft^2$ with 10,000 BTU/hr/$ft^2$ being typical for the present embodiment.

It should be understood that a very short gaseous residence time in the retort is desirable to avoid thermal cracking of the high molecular weight hydrocarbon vapors at temperatures of about 950° F. and higher. For temperatures in the 950° F. to 1,300° F. range, gaseous residence times of five seconds or less are desirable to avoid measurable cracking of the desirable hydrocarbons. Conversely, with gaseous residence times of one to two seconds, hydrocarbon cracking requires temperatures in the 1,650 to 1,850° F. range. For a 9-foot diameter retort having a length of 100 feet, the gaseous interior volume is calculated to be 4,500 cubic feet (30% filled with coal/char). With a sweep gas flow of 82,000 actual cubic feet per minute, the residence time is in the range of about 0.3 seconds. In one embodiment, the average gaseous residence time within the retort 14 is within a range of from about 0.2 second to about one second. In an alternative embodiment, the average gaseous residence time within the retort 14 is less than about one second.

FIG. 2 illustrates an enlarged, schematic cross-sectional view of a gas-heated retort 14 used in accordance with the illustrated process. In this embodiment, the rotary shell wall 18 can be fitted with an external heat exchange enhancing device 66 and an internal heat exchange enhancing device 68, which can be referred to as extended heat exchange surfaces, akin to fins on a heat exchanger surface. The rotary retort inner shell 16 is mounted for rotation within a cylindrical outer shell 19. The outer shell 19 includes a heat source (e.g., gas combustion products) for supplying indirect heat to the inner shell 16. At least one indirect heating gas inlet 70 is configured within the outer shell 19 for entry of the gas 72. At least one indirect heating gas outlet 74 is configured within the outer shell 19 for removal of the gas 72. The partially heat depleted oxygen deficient high sensible heat gases 17 are vented from the outer shell 19 of the retort chamber 14 to an upstream coal drying and preheating apparatus (not shown).

Figure 3:
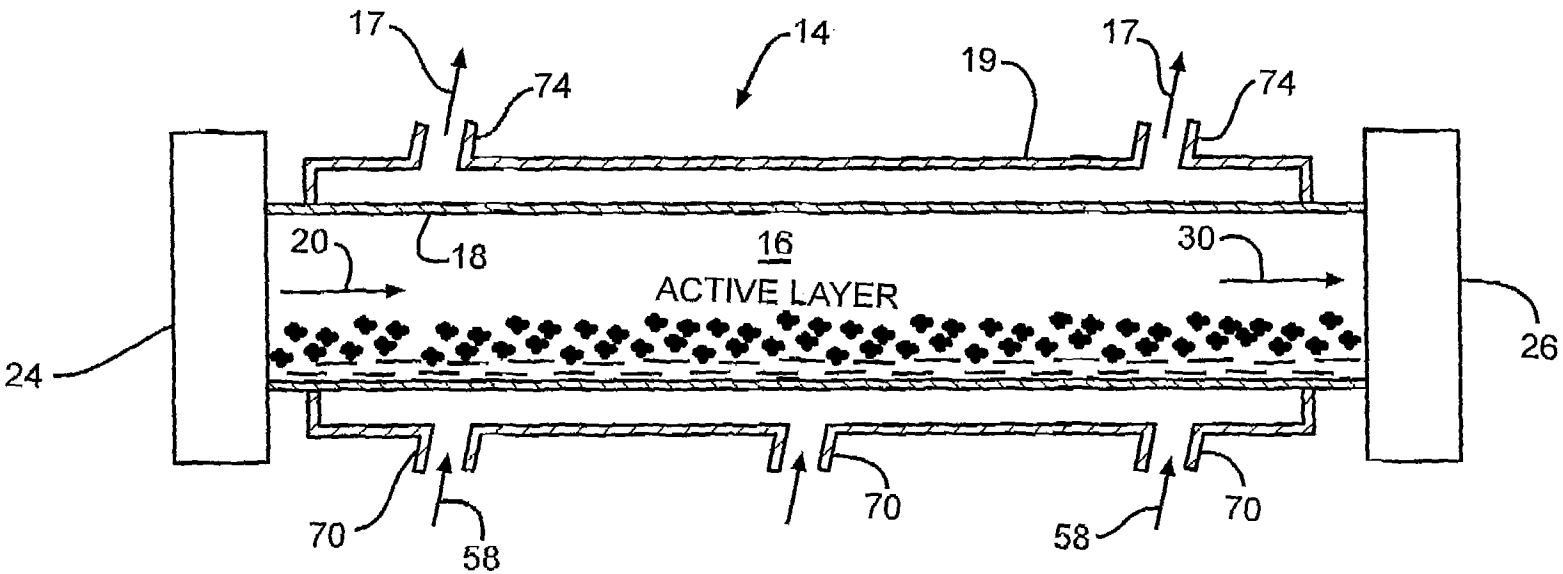
FIG. 3 is an enlarged, schematic side view in cross-section of the gas-heated retort of FIG. 2.

FIG. 3 illustrates an enlarged, schematic side view of the gas-heated retort 14 of FIG. 2 described above. In this embodiment, the sweep gas 20 is continuously supplied into one end of the chamber 14 at the charge end 24 and removed from another end of the chamber at the discharge end 26, and the average velocity of the sweep gas is less than 900 feet per minute. In a further embodiment, when the proportion of the heat supplied to the coal by the sweep gas is less than 40% of the total heat supplied to the coal, the sweep gas exiting the chamber 14 has a condensable hydrocarbon content of at least 12% by weight.

Figure 4:
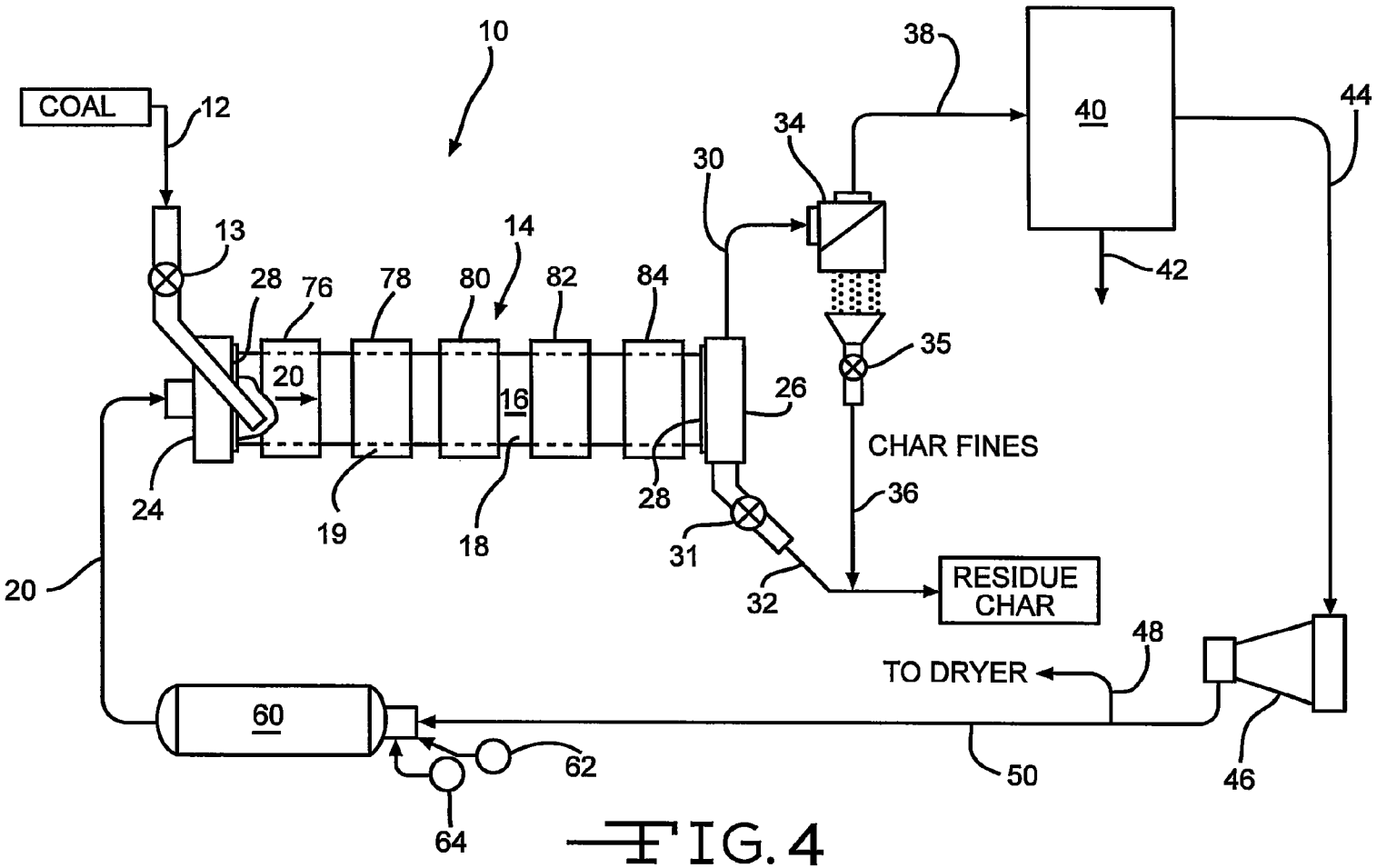
FIG. 4 is schematic illustration of a process for treating coal using indirect electrical heating.

Following the removal of the sweep gas 20 from the chamber 14, the sweep gas is appropriately treated to remove condensable components of the coal 12, including hydrocarbons, water vapor, and other volatile compounds, in accordance with the process 10 schematically illustrated in FIGS. 1 and 4. The sweep gas 20 is passed into a mechanical filter 34 to separate solid coal char fines 36 from the desirable gaseous hydrocarbon compounds. The coal char fines 36 can be controllably released from the filter 34 via a fines outlet rotary valve 35. The gas stream 38 is next passed into a single- or multi-stage quench tower absorber system 40 complete with single or multiple heat removal stages to separate the desirable condensable hydrocarbon compounds 42 and other compounds singularly or in a multiplicity of fractions as may be required to recover the desirable coal derived liquids. A non-condensed process derived gaseous fuel 44 then exits from the absorption system 40 and flows into a downstream process derived gaseous fuel compressor 46.

Optionally, the gaseous fuel 44 can be passed through a final stage quench tower (not shown) to remove a portion of the contained water vapor. Some of the non-condensed gaseous coal derived fuel 50 is optionally ducted to a combustor 52 for combination with an auxiliary fuel, if necessary, and air and/or oxygen, to form oxygen deficient products of combustion 58 supplied to the retort as described below. It is to be understood that the oxygen deficient products of combustion 58 for indirect heating in the retort 14 need not be entirely oxygen deficient, but can contain up to no greater than 2% by volume oxygen.

Optionally, the oxygen deficient products of sweep gas stream 20 utilized for pyrolysis of the coal 12 is produced by a gas combustor 60, which is ignited by process derived gaseous fuel 50 after having passed through the gaseous fuel compressor 46. An oxygen injection manifold 62 is connected to the gas combustor 60 and directs a fuel and air mixture thereto. An optional water injection manifold 64 can be used to supply water to the sweep gases. Prior to combustion, a portion of the process derived gaseous fuel 50 can optionally be vented through vent 48 and utilized in an upstream coal drying process. When the indirect heating source is gas, a portion of the process derived gaseous fuel 50 not combusted for production of the sweep gases 20 can be passed through an indirect heating gas combustor 52, and compressed high sensible heat products of combustion 58 for indirect heating can be removed therefrom and directed into the retort chamber 14. An auxiliary fuel, such as natural gas, and an oxidant, such as air, may be added to the combustor 52 along with water and coal derived gaseous fuel to form oxygen deficient products of combustion 58 (up to no greater than 2% by volume oxygen) having an exit temperature in the range of about 1100° F. to 2100° F. to maintain appropriate high sensible heat process temperatures. Combustion air 56 can be added to the combustor 52 via a combustion air blower 54.

It is further contemplated that increased energy efficient volatilization and desorption cooling process stages can be realized by using less sweep gas, replacing the convective heat transfer of the sweep gas wholly or partially with additional indirect heating of the coal being treated in the pyrolytic retort 14. In one embodiment, the condensable hydrocarbon (C5+) components represent about 50% (25-75 wt %) of the volatiles evolved in the pyrolysis process. At this concentration, the condensation temperatures are more representative of the respective boiling points and the volatile hydrocarbons can be efficiently cooled, condensed and separated in a multi-stage downstream absorption system (shown as a single-stage absorption system 40 in FIGS. 1 and 4) into groupings of specific desirable boiling point fractions (condensed hydrocarbons shown as element 42 in FIGS. 1 and 4).

The size of the absorption apparatus 40, including the necessary heat exchangers, is a function of the volume of sweep gas 30 (gas, water vapor and condensable hydrocarbons) exiting from the pyrolytic retort 14. The size of the apparatus 40 can be much smaller for gas systems having condensable hydrocarbon concentrations of about 20% or greater than the sized required for gases with lower concentrations. In one embodiment, the size of the apparatus 40 can be reduced by a factor of 725,000 lbs/hr vs. 220,000 lbs/hr (3.3 times) for a pyrolytic process employing 50% indirect heating and 50% co-current flow high sensible heat oxygen deficient gas direct heating.

FIG. 4 is a schematic illustration of an alternative embodiment of the process 10 of the present invention in which electric resistance heating is the indirect heating source of the outer shell 19 of the rotary retort 14. Typically, electric power is a more costly form of energy, when compared with common industrial fuels. On the other hand, use of electric resistance heating is nearly 100% efficient, as compared to gas fired systems, which are in the range of about 55 to 60% efficient when exhausted at 1300-1500° F. Electric resistance heating equipment is generally less costly than a gas fired heating system of the same effective heat input. A further advantage of electric resistance heating is the ease of setting up multiple heat control zones along the length of the retort and profiling of the heating elements so as to effectively match input and demand for a rotary retort embodiment adapted for pyrolysis of various types of dried and preheated coal. As shown in FIG. 4, the rotary retort 14 can be subdivided into different indirect electric resistant heat zones 76, 78, 80, 82, 84, such as the five shown in the present embodiment.

FIG. 5 is an enlarged, schematic cross-sectional view of an electrically heated retort 14 used in the process of FIG. 4. In this embodiment, the rotary shell wall 18 can be fitted with an external metal extended surface 66 and an internal metal extended surface 68. The rotary retort inner shell 16 is mounted for rotation within a cylindrical outer shell 19. A plurality of electric resistance heating elements 86 are selectively positioned around an inner wall 21 within the outer shell 19 of the rotary retort 14.

The present invention is further defined in the following Example, in which all parts and percentages are by weight and degrees are Fahrenheit, unless otherwise stated. It should be understood that this Example is given by way of illustration only. From the discussion herein and this Example, one skilled in the art can ascertain the essential characteristics of this invention, and without departing from the spirit and scope thereof, can make various changes and modifications of the invention to adapt it to various usages and conditions.

EXAMPLE

In a series of actual pilot scale tests, a low rank coal (i.e., Powder River Basin coal) is upgraded into the equivalent of a Pocahontas low volatile coal. The volatile content of the coal was reduced from 45.39% (feed coal) to 9.71% (pyrolyzed coal). The volatile content of the feed coal (dry basis) was reduced by 87.2%. Process conditions necessary to accomplish this were a dried coal feed rate of 32 lbs/hr, a kiln residence time of 22 minutes, and kiln retort temperatures averaging about 1150° F.

The solids mass balance includes 32.2 lbs/hr dried coal fed, 18.6 lbs/hr pyrolyzed coal collected, 10.6 lbs/hr (estimated) of volatiles exhausted, and 1.6 lbs/hour of water vaporized and exhausted. This leaves 1.4 lbs/hr of material unaccounted for; as for drying, this is attributed to dust entrained in the exhaust. This number is greater than for drying due to the higher lofting tendency of the dried coal as well as the particle size reduction induced by a second pass of the coal (drying and pyrolyzing) through the feed auger. The 32.2 lbs/hr of dried coal fed and 18.6 lbs/hr of coal char recovered results in a yield of 0.58 lbs of char per pound of dried coal fed. Similar yields could be expected from other Powder River Basin coals.

Mercury content (dry basis) of the coal was reduced from 0.081 ppm (feed coal) to 0.012 ppm (pyrolyzed coal). This represents a mercury reduction of 85%. Further, the Powder River Basin feed coal contained 9.2% ash (dry basis) versus 4.8% ash (dry basis) in pyrolyzed coal.

The total sulfur content of the feed coal (dry basis) was determined by assay to be 0.41% with the organic sulfur component being 0.40%. The thermal pyrolytic treatment was adequate for removal of 47.1% of the organic sulfur in the feed coal.

While the invention has been described with reference to various and preferred embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

Therefore, it is intended that the invention not be limited to the particular embodiment disclosed herein contemplated for carrying out this invention, but that the invention will include all embodiments falling within the scope of the claims.

What is claimed is:

1. A process for treating coal, comprising:

heating coal in a chamber by (a) direct heat provided by an oxygen-deficient sweep gas flowed through the chamber and brought into contact with the coal, and (b) by indirect heat applied externally to the chamber, said heating of the coal being sufficient to cause volatile components of coal to be released into the sweep gas, the volatile components including condensable hydrocarbons, selecting a ratio of direct heat and indirect heat applied to the coal to increase the proportion of condensable hydrocarbons in the sweep gas to 15% or more; and treating the sweep gas to recover condensable hydrocarbons of the coal, wherein coal is continuously supplied into one supply end of a chamber and removed from another discharge end of the chamber, and the sweep gas is continuously supplied into the same supply end of the chamber and removed from the discharge end of the chamber in co-current flow; and wherein the log mean temperature differential between the sweep gas and the coal from the supply end to the discharge end is from about 300° F. to about 400° F.

2. The process of claim 1 wherein the proportion of heat supplied to the coal by the sweep gas is less than 40% of the total heat supplied to the coal.

3. The process of claim 1 wherein the proportion of heat supplied to the coal by the sweep gas is about one-third of the total heat supplied to the coal.

4. The process of claim 1 wherein the temperature differential between the sweep gas and the coal at the supply end of the chamber is from about 650° F. to about750° F.

5. The process of claim 1 wherein the temperature differential between the sweep gas and the coal at the discharge end of the chamber is from about 100° F. to about200° F.

6. The process of claim 1, wherein the chamber is a rotary retort and the average velocity of the sweep gas is less than about 900 feet per minute.

7. The process of claim 1, wherein the chamber is a rotary retort, and the sweep gas is continuously supplied into one end of the retort and removed from another end of the retort, and wherein the average gaseous residence time within the retort is less than about one second.

8. The process of claim 7, wherein the average gaseous residence time within the retort is within a range of from about 0.2 second to about one second.

9. The process of claim 1, wherein, upon introduction to the chamber, the sweep gas has a temperature from about 1200° F. to about 1800° F.

10. The process of claim 1, wherein the sweep gas has a specific heat of about 0.39BTU/lb-F.

11. The process of claim 1, wherein the sweep gas removed from the chamber includes a concentration of coal fines reduced to about 4.5 wt % or less.

12. The process of claim 11, further comprising passing the sweep gas stream through a mechanical gas/fines filter to further reduce the coal fines by up to 95%.

13. The process of claim 1, further comprising raising the temperature of the coal within the chamber to a temperature from about 1200° F. to about 1500° F. for removal of organic sulfur.

14. The process of claim 1, wherein the sweep gas composition includes carbon dioxide and water, together comprising at least 80% by weight of the composition, and includes not more than 2% oxygen by volume.

15. The process of claim 1, wherein the sweep gas supplied into the chamber has an emissivity within a range of from about 0.5 to 0.7.

16. The process of claim 1, wherein coal is continuously supplied into one end of the chamber and removed from another end of the chamber, the sweep gas is continuously supplied into one end of the chamber and removed from another end of the chamber, and the mass ratio of the sweep gas to the coal supplied to the chamber is less than about 0.50.

17. The process of claim 1, wherein the condensable hydrocarbons comprise 25% to 75% of the volatile components of coal.

18. The process of claim 17, wherein condensing the condensable hydrocarbons further comprises separating the hydrocarbons into fractions by boiling point in a downstream absorption system.

19. The process of claim 2, wherein the less than 40% proportion of heat supplied by the sweep gas enables reduced sweep gas volume, the process further comprising condensing the condensable hydrocarbons in a downstream absorption system of reduced size commensurate with the reduced sweep gas volumes.

20. Coal char produced by the process of claim 1 further comprising a mercury content reduced by about 80% relative to feed coal.

21. Coal char produced by the process of claim 1 further comprising an organic sulfur content of about 45% less than an organic sulfur content in feed coal.

22. A process for treating coal, comprising:

heating coal in a chamber by (a) direct heat provided by an oxygen-deficient sweep gas flowed through the chamber and brought into contact with the coal, and (b) by indirect heat applied externally to the chamber, said heating of the coal being sufficient to cause volatile components of coal to be released into the sweep gas, the volatile components including condensable hydrocarbons, selecting a ratio of direct heat and indirect heat applied to the coal to increase the proportion of condensable hydrocarbons in the sweep gas to 15% or more; and treating the sweep gas to recover condensable hydrocarbons of the coal, wherein coal is continuously supplied into one supply end of a chamber and removed from another discharge end of the chamber, and the sweep gas is continuously supplied into the same supply end of the chamber and removed from the discharge end of the chamber in co-current flow; and wherein the temperature differential between the sweep gas and the coal at the discharge end of the chamber is from about 100° F. to about 200° F.

23. The process of claim 22 wherein the proportion of heat supplied to the coal by the sweep gas is less than 40% of the total heat supplied to the coal.

24. The process of claim 22 wherein the proportion of heat supplied to the coal by the sweep gas is about one-third of the total heat supplied to the coal.

25. The process of claim 22 wherein the log mean temperature differential between the sweep gas and the coal from the supply end to the discharge end is from about 300° F. to about 400° F.

26. The process of claim 22, wherein the chamber is a rotary retort and the average velocity of the sweep gas is less than about 900 feet per minute.

27. The process of claim 22, wherein the chamber is a rotary retort, and the sweep gas is continuously supplied into one end of the retort and removed from another end of the retort, and wherein the average gaseous residence time within the retort is less than about one second.

28. The process of claim 27, wherein the average gaseous residence time within the retort is within a range of from about 0.2 second to about one second.

29. The process of claim 22, wherein, upon introduction to the chamber, the sweep gas has a temperature from about 1200° F. to about 1800° F.

30. The process of claim 22, wherein the sweep gas has a specific heat of about 0.39BTU/lb-F.

31. The process of claim 22, wherein the sweep gas composition includes carbon dioxide and water, together comprising at least 80% by weight of the composition, and includes not more than 2% oxygen by volume.

32. The process of claim 22, wherein the sweep gas supplied into the chamber has an emissivity within a range of from about 0.5 to 0.7.

33. The process of claim 22, wherein the condensable hydrocarbons comprise 25% to 75% of the volatile components of coal.

34. The process of claim 33, wherein condensing the condensable hydrocarbons further comprises separating the hydrocarbons into fractions by boiling point in a downstream absorption system.

35. Coal char produced by the process of claim 22 further comprising a mercury content reduced by about 80% relative to feed coal.

36. Coal char produced by the process of claim 22 further comprising an organic sulfur content of about 45% less than an organic sulfur content in feed coal.

* * * * *